US006888300B2

(12) United States Patent
Gelten et al.

(10) Patent No.: US 6,888,300 B2
(45) Date of Patent: May 3, 2005

(54) CATHODE RAY TUBE

(75) Inventors: Ronald Johannes Gelten, Eindhoven (NL); Heidrun Steinhauser, Eindhoven (NL); Berend Jan Willem Ter Weeme, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 93 days.

(21) Appl. No.: 10/266,276

(22) Filed: Oct. 8, 2002

(65) Prior Publication Data

US 2003/0085667 A1 May 8, 2003

(30) Foreign Application Priority Data

Oct. 12, 2001 (EP) ..... 01203912

(51) Int. Cl.[7] ..... H01J 29/46
(52) U.S. Cl. ..... 313/441; 313/412
(58) Field of Search ..... 313/412, 413, 313/421, 426, 430, 432, 441, 458

(56) References Cited

U.S. PATENT DOCUMENTS 2,930,931 A 3/1960 Aiken ..... 315/16

FOREIGN PATENT DOCUMENTS

| | | | |
|---|---|---|---|
| EP | 0642140 A2 | 3/1995 | ..... H01J/29/50 |
| EP | 0905739 A2 | 3/1999 | ..... H01J/29/46 |
| WO | WO9934392 | 7/1999 | ..... H01J/29/70 |

*Primary Examiner*—Vip Patel

(57) ABSTRACT

A cathode ray tube includes a display for presenting an image, a deflection device, and an electron gun including electron-generating cathodes for generating electron beams. The CRT includes an electron beams controller for varying the trajectory of at least a first electron beam of the electron beams as a function of the intensity of at least the first electron beam, in order to compensate for changes in the convergence angle between electron beams near the display. The electrom beam controller is arranged between the electron-generating cathodes and the deflection device.

20 Claims, 7 Drawing Sheets

CATHODE RAY TUBE

FIELD OF THE INVENTION

The present invention relates to a cathode ray tube (CRT) comprising a display for presenting an image, a deflection device, and an electron gun comprising electron-generating cathodes for generating electron beams. The invention also relates to an electron gun for use in a CRT and a display apparatus comprising a CRT.

BACKGROUND OF THE INVENTION

Many modem display devices are based on colour cathode ray tubes (colour CRTs) corresponding to the type presented above. In some advanced colour CRTs, such as the one described in WO 99/34392, the trajectories of the electron beams of the CRT are changed dynamically in order to adapt the electron beams to an increased distance between a colour-selecting electrode and the inner surface of the display. More specifically, the distance between the electron beams at the location of the deflection plane is changed as a function of the deflection of the beam across the display, i.e. as a function of the desired landing coordinates of the electron beams on the display.

However, this colour CRT, as well as many other types of CRTs, have a tendency to present variations in the purity of the white colour, i.e. deteriorated white uniformity, in the image presented on the display.

OBJECT AND SUMMARY OF THE INVENTION

It is an object of the present invention to improve the white uniformity of an image presented on the display of a CRT.

This object is accomplished by means of a CRT as defined in claim 1 and by means of an electron gun as defined in claim 8. Preferred embodiments of the invention are defined in the dependent claims.

The present invention is based on the finding that one reason of the deteriorated white uniformity is that the electron beams repel each other when they come close to each other as they converge towards the intended landing spot on the display. As a result of the electron beam repulsion, single beams will get an unfavourable angle of approach towards the display and, consequently, they will arrive at an incorrect position on the display. These effects result in discolorations in the image that is to be presented on the display. The beams repel each other more when the beam has a high intensity, i.e. a high beam current, than when the beam has a low intensity, i.e. a low beam current. An increasing intensity of the electron beams increases the error and, thus, the discoloration is greater when the intensity of the electron beams is higher. Consequently, the discoloration is most evident in the bright white colours of the display.

According to one aspect of the invention, the cathode ray tube (CRT) comprises a display for presenting an image, a deflection device, and an electron gun comprising electron-generating cathodes for generating electron beams. Said CRT also comprises an electron beam controller for varying the trajectory of at least a first electron beam of the electron beams as a function of the intensity of at least said first electron beam, in order to compensate for changes in the convergence angle between electron beams near the display. The electron beam controller is positioned between the electron-generating cathodes and the deflection device.

By providing the CRT with said electron beam controller that varies the trajectory of at least one electron beam as a function of the intensity of at least one electron beam, the CRT system is enabled to compensate for the beam repulsion expected to be close to the display and, thus, the convergence angle of the electron beams near the display can be kept as close to the optimal convergence angle as possible, despite variations of the intensity of the electron beams.

This is also achieved by means of an electron gun comprising said electron beam controller and by means of a display apparatus comprising the CRT according to the invention.

The electron beams travel from a main lens to the display and, due to said beam repulsion, the convergence angle between two electron beams changes during this travel. In the context of the invention, the main lens is an electron-optical lens that converges and/or focuses the electron beams towards a position on the display representing a specific image element. The repulsion has the effect that the convergence angle between two electron beams near the display becomes smaller than the convergence angle between two beams near the main lens. Also, as a result of the change in convergence angle, the electron beams do not land correctly at their intended landing spots. In order to compensate for the decrease of the convergence angle between two beams near the display, the electron beam controller can be arranged to vary the trajectories of the electron beams so that the convergence angle and distance between two beams near the main lens is increased as a function of the intensity of the electron beams. Thus, as a result of the increased angle between two electron beams near the main lens and the increasing repulsion between electron beams when they approach each other, the angle between two beams approaches the desired angle near the display.

One way of achieving the increased convergence angle near the main lens is to arrange the electron beam controller to vary the trajectory of at least said first electron beam so that the distance between said first electron beam and a second electron beam of the electron beams, when they are in the proximity of the main lens, is varied as a function of the intensity of at least said first electron beam. The second electron beam could also be an electron beam whose trajectory is varied in accordance with the invention.

By varying the distance between the beams, as mentioned above, the convergence angle between two beams near the main lens can be varied. A greater distance between beams when they pass the main lens results in a greater convergence angle near the main lens, and, thus, the beam repulsion near the display can be compensated.

Additionally, said arrangement results in an increase of the average distance between the two beams during their travel from the main lens to the display and, thus, the overall mutual repulsion between the electron beams during their travel from the main lens to the display decreases. As a result, the resulting landing spots of the electron beams and the convergence angle between the electron beams near the display are not much compromised.

According to a preferred embodiment, said electron beam controller comprises at least one electron beam-directing section, in which, when in operation, the electron beams are arranged to be at such a distance from each other that the mutual repulsion between the electron beams varies the trajectory of at least said first electron beam.

In this embodiment, the direction of the electron beams, when they leave the electron beam-directing section, depends on the mutual repulsion of the electron beams. Consequently, the direction of at least the first electron beam is varied as a function of the intensity of the electron beams, e.g. an increasing beam current will result in a stronger mutual repulsion and, thus, in a greater variation of the trajectory. Self-correction of the beam trajectories in order to compensate for the beam repulsion present when the beams converge near the display is achieved in this way.

According to another embodiment of the invention, said electron beam controller comprises at least one electron beam-redirecting device which is connected to an electric potential that is a function of the voltage of at least one of the electron beam-generating cathodes.

By varying the voltage of the electron beam redirecting device as a function of the electric potential controlling the beam current, the trajectory of at least said first electron beam of the electron beams can be adjusted in order to compensate for the beam repulsion that occurs when the beams converge near the display. For example, in some electron guns, the electric potential controlling the beam current could be obtained from the voltage of the cathodes that generates the electron beams.

The electron beam-redirecting device could, for example, be an electromagnetic coil or an electrode. In one preferred embodiment, the redirecting device is an electrode having an electric potential that is arranged to vary as a function of the voltage that controls the beam current of at least said first electron beam of the electron beams. This implementation is more advantageous than the electromagnetic coil implementation in that it results in a more compact and robust electron beam-redirecting device.

Preferably, the electrode mentioned above includes three-dimensional protrusions. The protrusions make the electrodes more effective in varying the trajectories of electron beams. One reason is that it is possible to make the electric potential of the electrode affect the electron beams over a greater distance in the longitudinal direction of the electron gun.

In a preferred embodiment, the electron beam controller is arranged between the electron-generating cathode in the electron gun and a main lens in the electron gun. This arrangement contributes to the compactness and robustness of the CRT.

According to yet another preferred embodiment, the electron beam controller is arranged adjacent to the location of a beam crossover of each beam. After leaving the cathode, each electron beam is focused in a crossover, which serves as the object of the imaging system. Thus, if the electron beam controller is arranged close to the beam crossover, the variation of the beam trajectories is done more or less in the object-plane of the imaging system. As a result, no new convergence errors are introduced.

According to a preferred embodiment, the electron gun is arranged to generate electron beams that substantially extend in a common plane, and wherein the electron beam controller is arranged to vary the trajectory of the first and a second electron beam of the electron beams in said common plane as a function of the intensity of at least the first electron beam.

BRIEF DESCRIPTION OF THE DRAWINGS

The invention will now be described in more detail with reference to the accompanying drawings, which are given by way of illustration only, in which.

DESCRIPTION OF PREFERRED EMBODIMENTS

Figure 1:
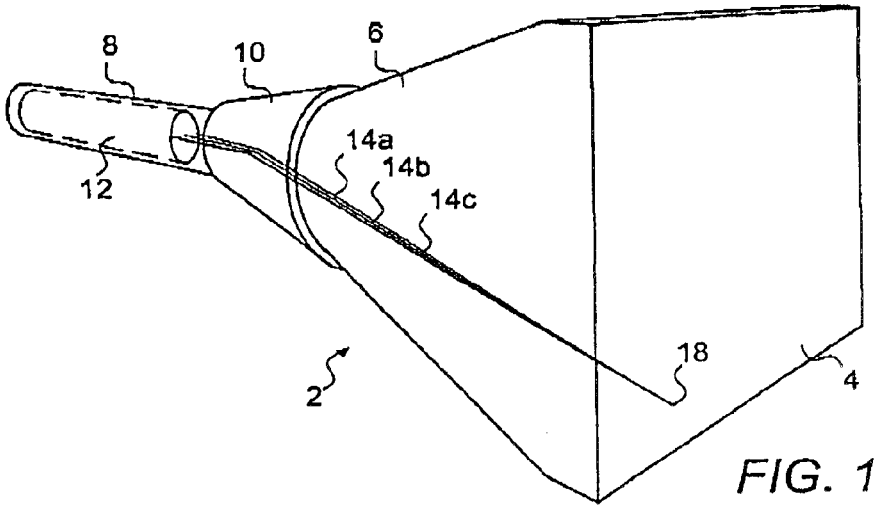
FIG. 1 is a schematic view of an ordinary CRT in which a preferred embodiment of the invention can be implemented.

In FIG. 1, a cathode ray tube 2 (CRT) is shown. The CRT could be any type of prior art CRT 2 that has been modified in accordance with the invention, as will be described below. The CRT 2 is arranged in a display apparatus, e.g. a television set, a computer display, an advertising display, etc. Preferably, the CRT 2 is a colour CRT.

The CRT 2 comprises a display 4, a cone 6, a neck 8, and a deflecting device 10. The neck 8 comprises an electron gun 12 that generates the electron beams 14*a–c*.

The generated electron beams 14*a–c* are deflected by means of the deflecting device 10 towards a position 18 on the display, the position corresponds to an image element of the image represented by the present electron beams.

A more detailed construction and function of an ordinary CRT is well known to a person skilled in the art and will therefore not be further described.

Figure 2A:
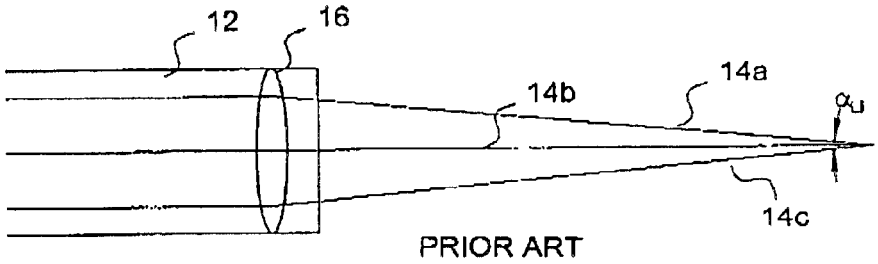
FIG. 2*a* is a schematic top view of a prior art electron gun providing electron beams of a low beam current.
Figure 2B:
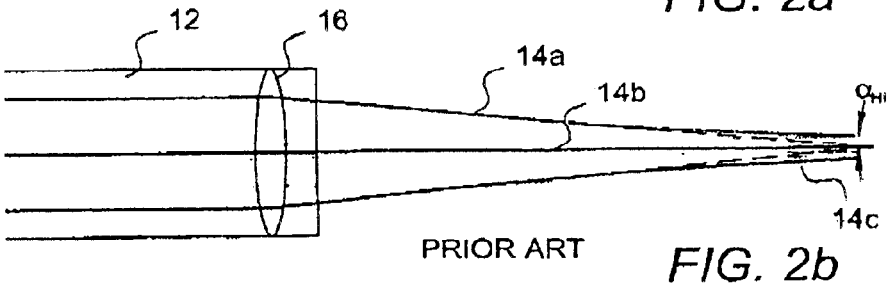
FIG. 2*b* is a schematic top view of a prior art electron gun providing electron beams of a high beam current.

FIGS. 2*a* and 2*b* show electron beams 14*a–c* in an in-line configuration from a prior art electron gun, and the effect of the beam repulsion at a low beam intensity and at a high beam intensity, respectively. The electron beams 14*a–c* are generated in the electron gun and sent to the display (not shown) of the CRT via an electron-optical main lens 16. The electron beams 14*a–c* converge towards a predetermined position on the display. In this embodiment, the electron beams 14*a–c* are made to converge at the display by means of a main lens 16 arranged in the electron gun 12. It is also possible to arrange one or a plurality of electron-optical lenses outside the electron gun for performing the function of converging the electron beams 14*a–c* towards the display. In the context of the invention, such electron-optical lenses are also considered part of the main lens. FIG. 2*a* depicts the trajectory of the beams 14*a–c* having a low intensity. The repulsion between the beams when they approach the display is small, no effect being visible in the Figure, and the angle between the red beam 14*a* and the green beam 14*b* near the display is $\alpha_{LI}$. Thus, the white uniformity is not much deteriorated.

FIG. 2*b* depicts beams 14*a–c* having a high intensity. The repulsion between the beams 14*a–c* when they approach the display is stronger, which results in a smaller angle $\alpha_{HI}$ between the red beam 14*a* and the green beam 14*b* near the display, as seen in the Figure, i.e. $\alpha_{HI}<\alpha_{LI}$. Thus, at least the beams 14*a,c* reach the display at a distance from the intended position in the plane of the display and, consequently, an intended bright area on the screen is not visualised with the expected colour.

The deteriorated white uniformity is a problem that is present in at least all colour CRTs. Also, the effect of the beam repulsion deteriorates, both visually and with regard to change of position/angle of the beams, with an increasing resolution. The deteriorated white uniformity will thus become a more and more evident problem as the resolution of CRTs increases. According to the invention, the improved white uniformity is achieved by varying the trajectories of the electron beams 14*a–c* as a function of the intensity of the electron beams 14*a–c*. It is also possible to vary the trajectory as a function of one of the electron beams 14*a–c*.

Figure 3A:
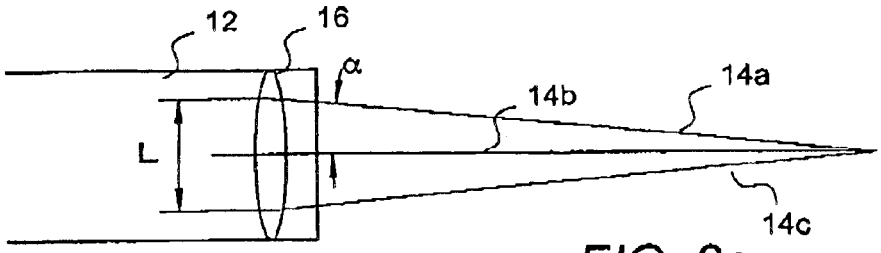
FIG. 3*a* is a schematic top view of an electron gun according to the preferred embodiment of the invention providing electron beams of a low beam current.
Figure 3B:
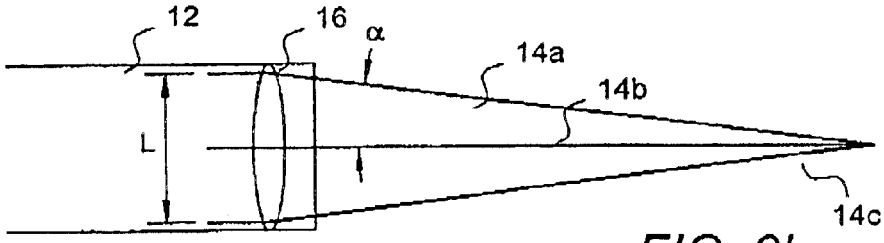
FIG. 3*b* is a schematic top view of an electron gun according to the preferred embodiment of the invention providing electron beams of a high beam current.

Now referring to FIGS. 3*a* and 3*b*, in a preferred embodiment of the invention, the trajectories of two of the electron beams 14*a*, 14*c* are modified so that the distance L between the beams 14*a* and 14*c* near the main lens 16 is varied as a function of the intensity of one or a plurality of beams. By increasing the distance L between the beams 14*a* and 14*c*, as shown in FIG. 4*b*, the angle α between the beams 14*a* and 14*b* near the display becomes greater than the corresponding angle α in FIG. 3*a* and thus compensates for the change of convergence angle that arises during the travel of the beams towards the display resulting from the increased beam repulsion, which was described in FIG. 2*b*. Also, the overall distance between the beams, during the transport from the main lens towards the display, is increased, which results in a decrease of the effect of beam repulsion.

The control of the electron beams for achieving the distance between the electron beams just before they are directed towards one another in order to converge and hit the display with the aim of defining a point of an image, could be performed within, outside, or both within and outside the electron gun 12. In the preferred embodiment of the invention, the electron gun 12 is modified in order to provide said control within the electron gun.

In the preferred embodiment of the invention, the electron gun could be of any type of electron gun that is possible to modify in accordance with the description of the preferred embodiment below. For example, it could be a standard electron gun such as the one described in FIG. 4*a*, or a more advanced electron gun such as the one described in FIG. 4*b*.

Figure 4A:
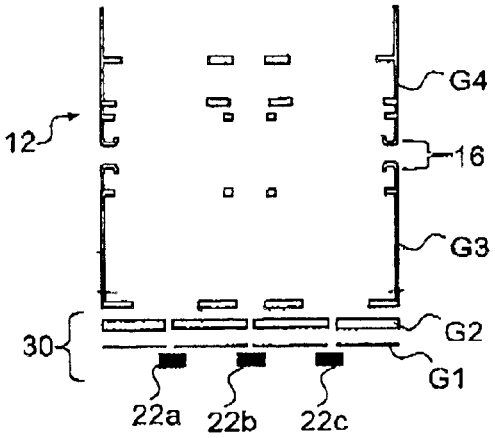
FIG. 4a PRIOR ART
FIG. 4*a* is a schematic top view of a standard prior art electron gun.
Figure 4B:
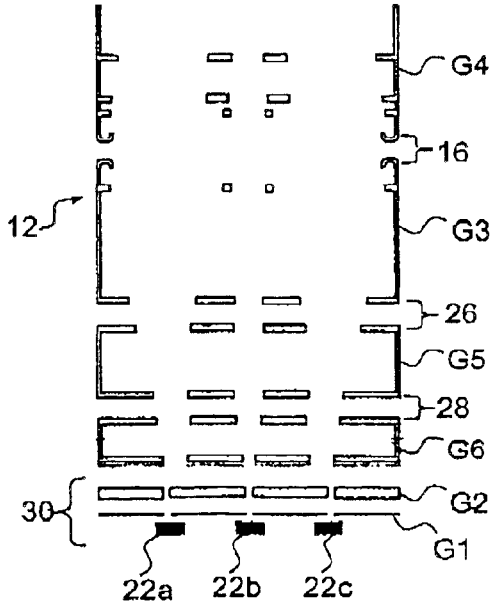
FIG. 4b PRIOR ART
FIG. 4*b* is a schematic top view of a more advanced prior art electron gun.

A standard electron gun 12, as shown in FIG. 4*a*, comprises cathodes 22*a–c*, from which the electrons of the electron beams originate, one cathode 22*a* for the electron beam defining red colour, one cathode 22*b* for the electron beam defining green colour, and one cathode 22*c* for the electron beam defining blue colour.

Furthermore, the electron gun 12 comprises electrodes G1, G2, G3, and G4, also called grids. Generally, a grid is a metal plate or a couple of connected metal plates in which apertures are arranged for guiding and controlling the electron beams. The different grids are kept at specific voltages in order to at least accelerate and focus the electrons of each beam and to focus the beams onto the display. A person skilled in the art knows the specific voltages needed for different types of electron guns. In most electron guns, a "crossover" for each beam is provided between G1 and G3. The electrons within a beam are focused in the crossover and, in principle, the electron beam spot on the display is an image of the crossover. The two grids G3 and G4 and their voltages form an electron-optical lens called main lens 16 for focusing each beam onto the display and possibly also for making the electron beams converge towards one another in order to define a point within the image that is to be presented on the display. The section of the electron gun 12 which comprises the cathodes and the first two grids G1 and G2 and is denoted by reference numeral 30 is generally called the triode section.

As shown in FIG. 4*b*, a more advanced standard electron gun 12 could comprise, for example, a combination of electrodes G3 and G5 defining a Dynamic Astigmatism and Focus (DAF) 26 section and a combination of electrodes G5 and G6 defining a Dynamic Beam Forming (DBF) 28 region. The DAF 26 makes it possible to vary the astigmatism effect of the main lens. The DBF 28 is used to vary the beam shape as a function of the intended position of the beam on the screen. The function of the DAF 26 and the DBF is well known to a person skilled in the art.

Figure 5:
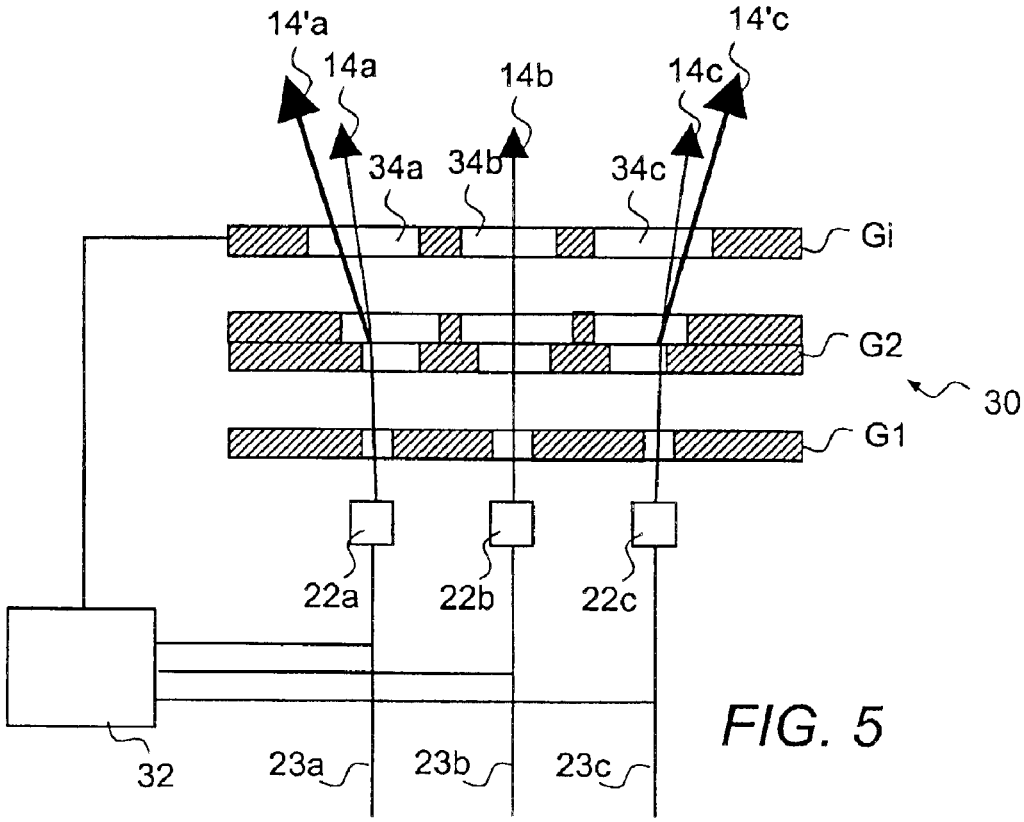
FIG. 5 is a schematic top view of a triode section within an electron gun according to an embodiment of the invention.

In FIG. 5, the triode section 30 of an embodiment of the invention is shown. The triode section 30 comprises a grid G1, which is usually connected to ground, i.e. set to 0 V, and a grid G2, which is set to 700 V. Furthermore, the triode section 30 comprises a grid G1. Each beam current and, thus, the intensity of each beam 14*a–c* are controlled by means of varying the voltage of each cathode between, for example, 20 and 160 V. The voltages of the cathodes 22*a–c* and the grids G1 and G2 presented above are standard voltages of an electron gun using cathode drive.

The grid Gi is driven by a voltage that varies as a function of the video signal controlling the beam currents. In this embodiment, which uses cathode drive, the voltage of Gi varies as a function of the voltages of the cathodes 22*a–c*. The voltage of Gi is typically varied between 0 and 300 V.

The voltage of Gi is provided by a grid voltage control device 32, which is connected to the lines 23*a–c* driving the cathodes 22*a–c*. The grid voltage control device 32 sums up the cathode voltages and provides a corresponding signal to the grid Gi. However, the grid voltage control device 32 could provide the grid Gi with a voltage corresponding to other functions of the cathode voltages 22*a–c*.

The grid Gi is provided with apertures 34*a–c*. The apertures 34*a,c* are positioned further from each other than the apertures in the grid G2 in order to "pull" the outer beams 14*a,c* (red and blue) from each other. The voltage at the grid Gi that is provided by the grid voltage control device 32 then determines to what extent the beams 14*a,b* are pulled from each other. The greater the beam current, i.e. intensity, the higher the voltage at Gi, the more the grid Gi pulls the beams apart, the greater the distance between the beams 14*a,b* becomes at the main lens. This is depicted in the Figure in which the beams denoted 14*a,c* correspond to the direction of the redirected beams when the sum of the beam currents is rather low and the beams denoted 14'*a,c* correspond to the direction of the redirected beams when the sum of the beam current is higher. Thus, the distance between the electron beams at the main lens is varied as a function of the beam currents and, as explained in connection with FIG. 3*a-b*, the deterioration of the white uniformity can be reduced.

Figure 6:
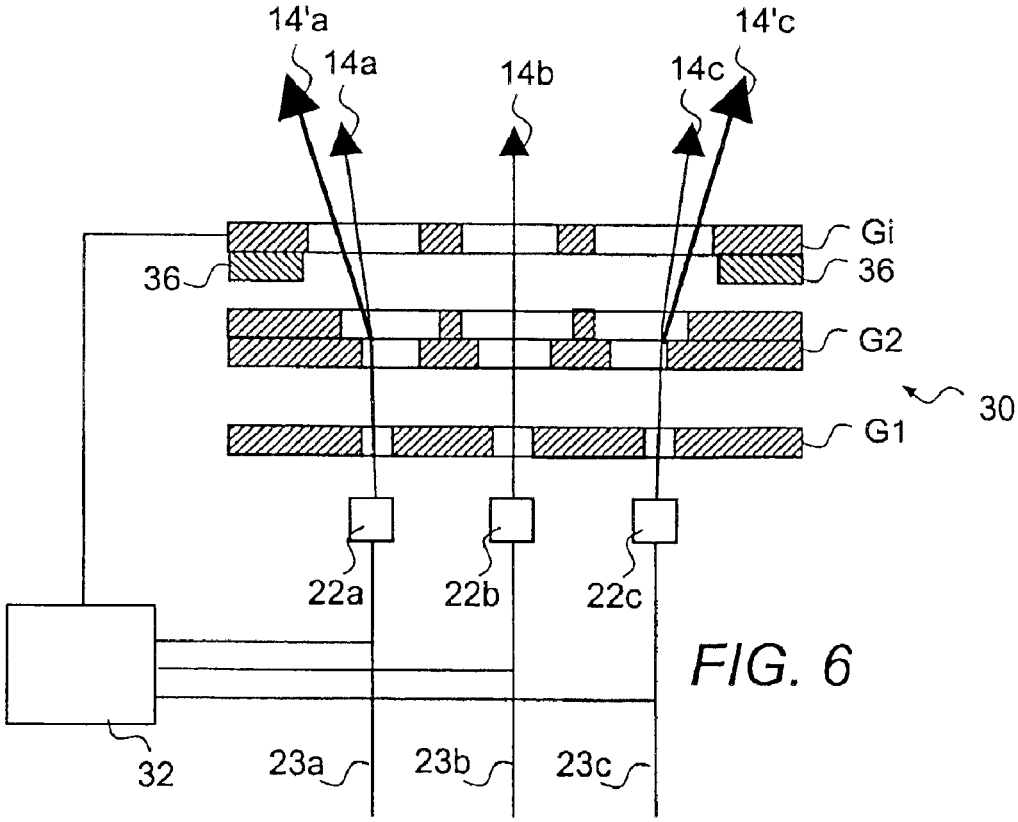
FIG. 6 is a schematic top view of a triode section within an electron gun according to a preferred embodiment of the invention.
Figure 7A:
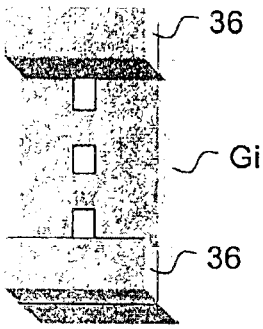
FIG. 7*a-f* is a schematic view of possible appearances of three-dimensional protrusions on a grid of the triode section in FIG. 7.
Figure 7B:
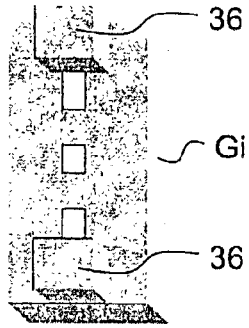
Figure 7C:
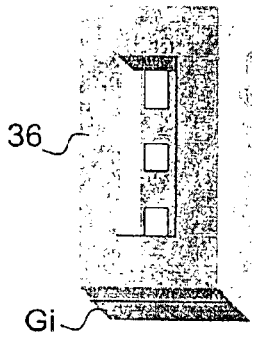
Figure 7D:
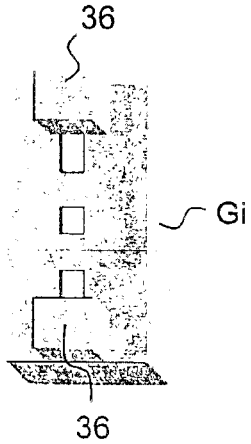
Figure 7E:
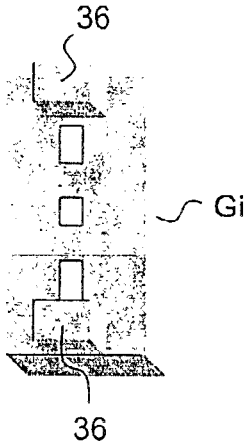
Figure 7F:
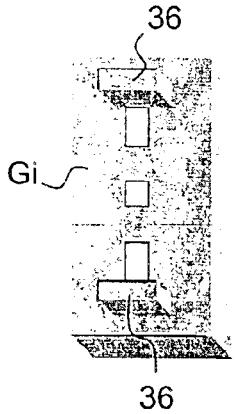

In the preferred embodiment, the grid Gi of the triode section described in FIG. 5 is provided with three-dimensional protrusions 36, as shown schematically in FIG. 6 and in more detail in FIG. 7*a-f*. The protrusions 36 make the redirecting of the beams more effective because the electron beams are affected by the voltage of Gi over an extended distance of travel. In addition, the G2 to Gi distance at one side of the aperture is smaller than on the other side, which makes the effect asymmetric. FIGS. 7*a–f* show some examples of the appearance of example protrusions 36. The protrusions are preferably of the same material as the grid and are electrically connected to the grid Gi.

According to another embodiment of the invention, the triode section 30 described in FIG. 5 is provided with an extra grid Ga. Ga is provided with the same electric potential as G2, e.g. 700 V. As a result, the grid Ga amplifies the beam deviation controlled by the grid Gi. Thus, a stronger beam deviation is achieved for higher beam currents.

Figure 9:
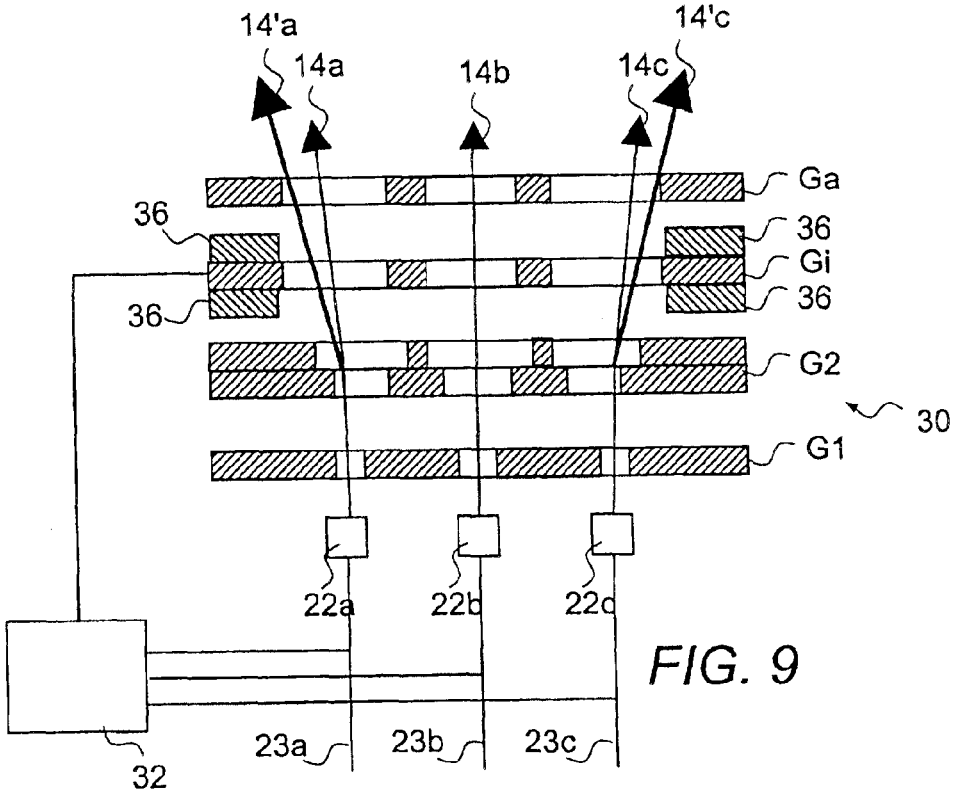
FIG. 9 is a schematic top view of a triode section within an electron gun according to yet another embodiment of the invention.

Furthermore, according to yet another embodiment, the triode sections 30 described in FIG. 6 and FIG. 7 are combined and, thus, a triode section 30 including both the grid Ga and the protrusions 36 on the grid Gi is obtained, which is shown in FIG. 9. Consequently, this results in even more effective redirecting of the electron beams. The voltage controller device 32 may therefore be made simpler and cheaper.

Figure 8:
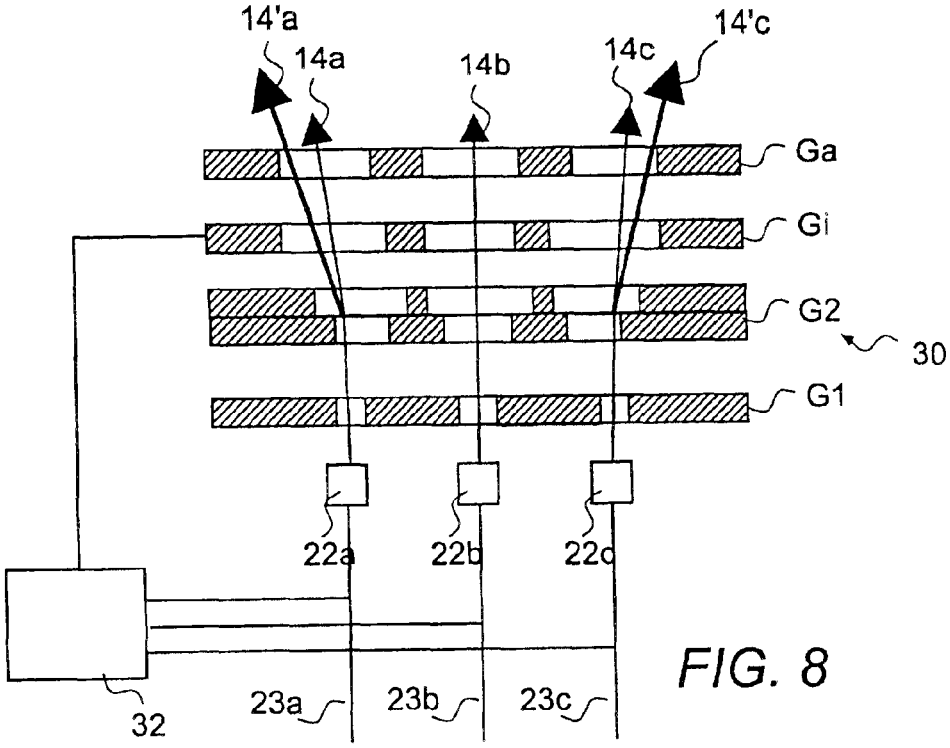
FIG. 8 is a schematic top view of a triode section within an electron gun according to another embodiment of the invention.
Figure 10B:
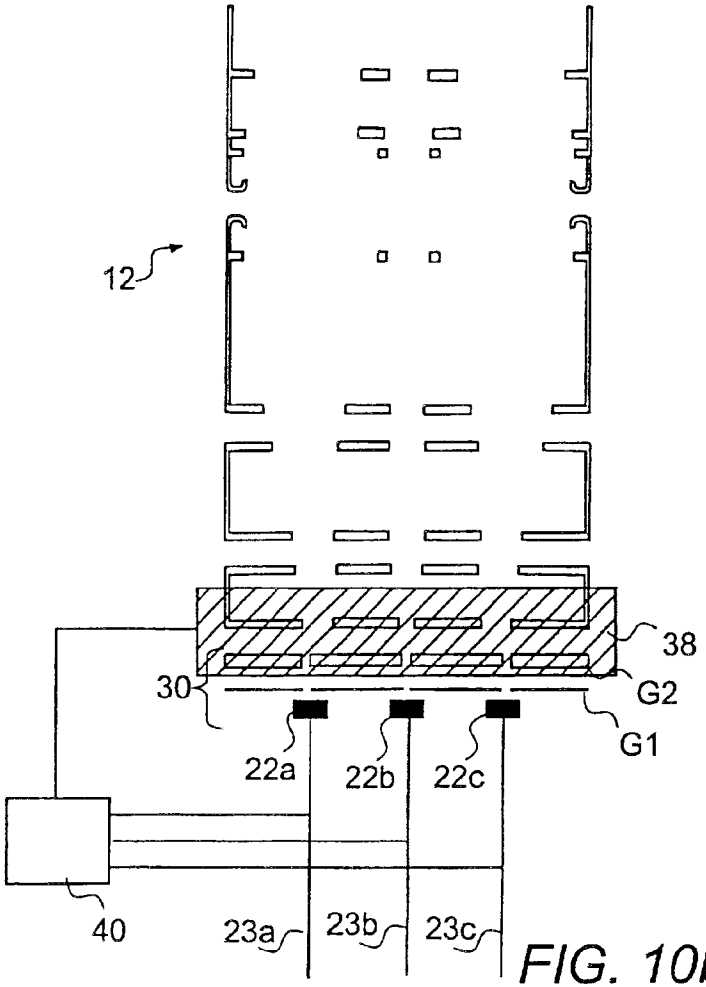
FIG. 10*b* is a schematic top view of an embodiment of the invention, in which a magnetic coil is used to vary the trajectories of the electron beams within a more advanced prior art electron gun.
Figure 10A:
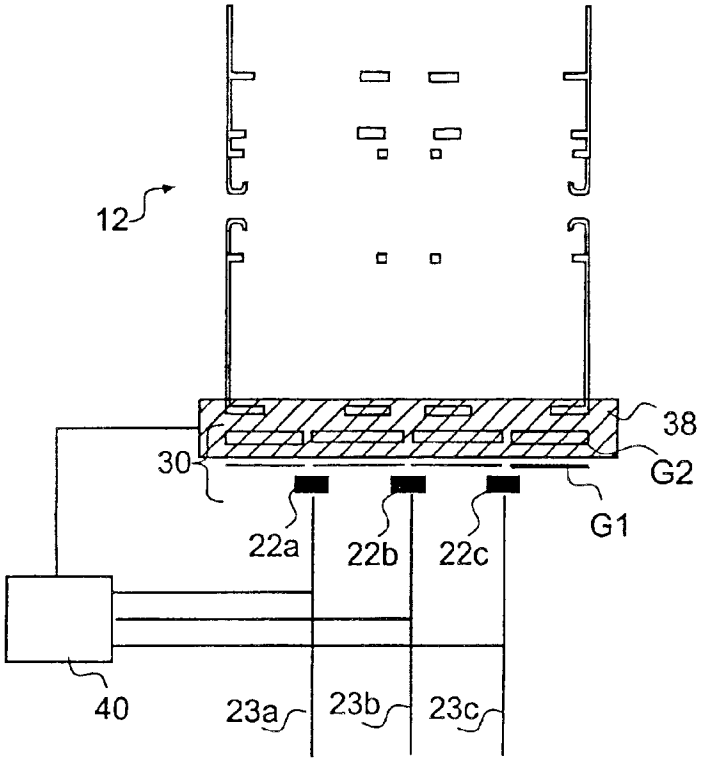
FIG. 10*a* is a schematic top view of an embodiment of the invention in which a magnetic coil is used to vary the trajectory of the electron beams within a standard prior art electron gun.

According to another embodiment, see FIGS. 10*a–b*, the redirecting of the electron beams as a function of the electron current is accomplished by means of an electromagnetic coil 38 that is arranged at the triode section 30 of the electron gun 12. In the examples, the electron gun 12 of FIG. 10*a* corresponds to the electron gun described in FIG. 4*a* and the electron gun 12 of FIG. 10*b* corresponds to the electron gun described in FIG. 4*b*. The electromagnetic coil 38 could be derived from a Scanning Velocity Modulation coil, which is a common device in TV sets. The magnetic field of the electromagnetic coil is controlled by means of a control device 40 corresponding to the grid voltage control device 32 in FIGS. 5, 6, and 8. The magnetic field of the coil 38 redirects the electron beam, so that the distance between the electron beams at the main lens increases with the electron beam current, as mentioned above in connection with FIG. 5.

Figure 11:
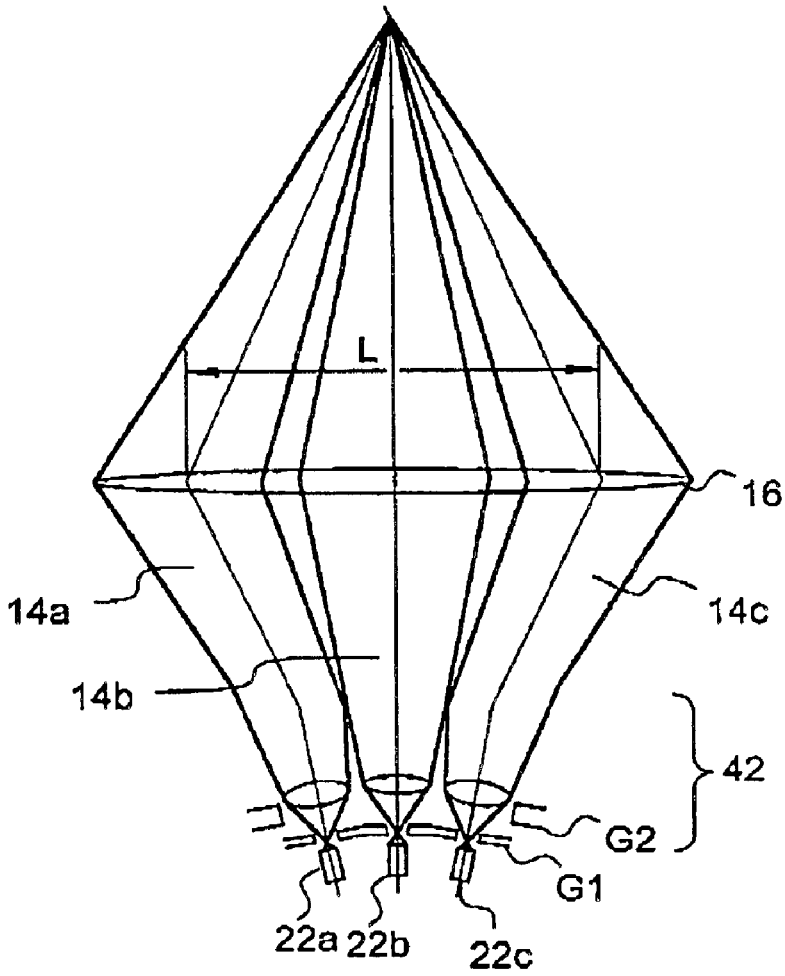
FIG. 11 is a schematic top view of another embodiment of the invention, in which the mutual repulsion of the electron beams is used in order to achieve the variation of the trajectories of the electron beams.

FIG. 11 shows yet another embodiment. This embodiment could be, for example, a modified version of the electron gun described in FIG. 4. In this embodiment, the cathodes 22*a–c* are positioned closer to each other than in a normal configuration, and the grids G1 and G2 are slightly adjusted in relation to the new electron beam origin. The grids G1 and G2 could even be slightly bent as shown in FIG. 11. The cathodes are positioned at such distance from each other that the mutual repulsion between the generated electron beams 14*a–c* drives the electron beams 14*a–c* apart, which is an effect that becomes stronger for higher currents. The electron beams 14*a–c* preferably travel at said distance from each other within a limited electron beam-directing section 42 of the electron gun 12. Thus, the directions of and the distance between the electron beams 14*a–c* will automatically be adjusted in accordance with the current beam currents. Thus the distance L (see FIGS. 3*a–b*) between the electron beams at the main lens 16 is achieved by means of the natural mutual repulsion between the electron beams 14*a–c*. Additionally, the electron beams 14*a–c* are preferably subject to the mutual repulsion when they are very close to the beam cross-over. This means that the deviation of the beams is performed more or less in the object-plane of the main lens. As a result, the main lens will automatically keep the convergences of the beams intact.

In all the embodiments, including the preferred embodiment, the electron beams are redirected as a function of the beam current in a section of the electron gun that is close to the beam cross-over. Consequently, in the embodiments shown, the electron beams are redirected as a function of the beam currents before they pass the first grid following G2, in respect of the travel direction of the electron beams 14*a–c*. Thus, the deviation of the beams is performed more or less in the object plane of the main lens. As a result, the main lens will automatically keep the convergence of the beams intact.

The invention is not restricted to the two types of electron guns described in FIGS. 4*a* and 4*b* and could be implemented in electron guns having different constructions and functions which are known to a person skilled in the art.

The invention being thus described, it will be obvious that the same may be varied in many ways. Such variations are not to be regarded as a departure from the spirit and the scope of the invention, and all such modifications as would be obvious to those skilled in the art are intended to be included within the scope of the following claims.

What is claimed is:

1. A cathode ray tube comprising:

a display for presenting an image, a deflection device, and an electron gun comprising electron-generating cathodes for generating electron beams, wherein the cathode ray tube includes electron beam controller means, positioned between the electron-generating cathodes and the deflection device, for compensating for changes in the convergence angle between electron beams near the display by varying the trajectory of at least a first electron beam of the electron beams as a function of the intensity of at least said first electron beam.

2. The cathode ray tube of claim 1, wherein said electron beam controller comprises at least one electron beam-directing section, in which, when in operation, the electron beams are arranged to be at such a distance from each other that the mutual repulsion between the electron beams varies the trajectory of at least said first electron beam.

3. The cathode ray tube of claim 2, wherein the electron beam controller is arranged between the electron-generating cathodes in the electron gun and a main lens in the electron gun.

4. The cathode ray tube of claim 2, wherein the electron beam controller is arranged adjacent to the location of a beam crossover of each beam.

5. A display apparatus including the cathode ray tube of claim 2.

6. The cathode ray tube of claim 1, wherein said electron beam controller comprises at least one electron beam-redirecting device which is connected to an electric potential that is a function of the voltage of at least one of the electron beam-generating cathodes.

7. The cathode ray tube of claim 6, wherein the electron beam-redirecting device is an electrode.

8. The cathode ray tube of claim 7, wherein the redirecting electrode is a third electrode after the electron-generating cathode in respect of the direction of motion of the electrode beams.

9. The cathode ray tube of claim 6, wherein the electron beam-redirecting device is an electromagnetic coil.

10. The cathode ray tube of claim 6, wherein the electron beam controller is arranged between the electron-generating cathodes in the electron gun and a main lens in the electron gun.

11. The cathode ray tube of claim 6, wherein the electron beam controller is arranged adjacent to the location of a beam crossover of each beam.

12. The cathode ray tube of claim 1, wherein the electron beam controller is arranged between the electron-generating cathodes in the electron gun and a main lens in the electron gun.

13. The cathode ray tube of claim 1, wherein said electron beam controller is arranged adjacent to the location of a beam crossover of each beam.

14. The cathode ray tube of claim 1, wherein the electron gun is arranged to generate electron beams that substantially extend in a common plane, and the electron beam controller is arranged to vary the trajectory of the first and a second electron beam of the electron beams in said common plane as a function of the intensity of at least the first electron beam.

15. An electron gun that generates electron beams, for use in the cathode ray tube of claim 1.

16. A display apparatus including the cathode ray tube of claim 1.

17. A cathode ray tube comprising:

a display for presenting an image;

a deflection device; and an electron gun comprising electron-generating cathodes for generating electron beams, wherein the cathode ray tube includes an electron beam controller, positioned between the electron-generating cathodes and the deflection device, for varying the trajectory of at least a first electron beam of the electron beams as a function of the intensity of at least said first electron beam, in order to compensate for changes in the convergence angle between electron beams near the display wherein the electron beam-redirecting device is an electrode that includes three-dimensional protrusions.

18. The cathode ray tube of claim 17, wherein the redirecting electrode is a third electrode after the electron-generating cathode in respect of the direction of motion of the electrode beams.

19. The cathode ray tube of claim 17, wherein the electron beam controller is arranged between the electron-generating cathodes in the electron gun and a main lens in the electron gun.

20. The cathode ray tube of claim 17, wherein the electron beam controller is arranged adjacent to the location of a beam crossover of each beam.

* * * * *